US005367845A

United States Patent [19]

Hartling

[11] Patent Number: 5,367,845

[45] Date of Patent: Nov. 29, 1994

[54] SYSTEM FOR BUILDING A STRUCTURE

[76] Inventor: Robert H. Hartling, 63B Niles Hill Rd., Apt. B3, New London, Conn. 06320

[21] Appl. No.: 15,647

[22] Filed: Feb. 9, 1993

[51] Int. Cl.[5] ..... F02D 27/00

[52] U.S. Cl. ..... 52/293.1; 52/742; 52/743; 52/294

[58] Field of Search ..... 52/292, 293.1, 293.2, 52/294, 742, 743

[56] References Cited

U.S. PATENT DOCUMENTS

| | | | |
|---|---|---|---|
| 1,340,656 | 5/1920 | Hughes et al. . | |
| 2,037,482 | 4/1936 | Oliver | 52/293.1 X |
| 2,134,941 | 11/1938 | Guignon, Jr. . | |
| 2,518,186 | 8/1950 | Rumble | 52/293.1 X |
| 2,676,482 | 4/1954 | Wilson . | |
| 3,287,866 | 11/1966 | Bevilacqua | 52/293.2 X |
| 3,685,241 | 8/1972 | Cooper | 52/293.1 X |
| 4,524,553 | 6/1985 | Hacker | 52/294 X |
| 4,565,044 | 1/1986 | Takahara | 52/294 X |
| 4,783,935 | 11/1988 | Creager | 52/743 X |
| 4,817,353 | 4/1989 | Woods | 52/742 X |
| 4,848,050 | 7/1989 | Tanaka | 52/293.1 X |
| 4,886,399 | 12/1989 | Pidgeon | 52/742 X |
| 4,894,969 | 1/1990 | Horobin . | |
| 4,967,528 | 11/1990 | Doran . | |
| 5,086,600 | 2/1992 | Holland et al. . | |
| 5,103,613 | 4/1992 | Kinoshita . | |

FOREIGN PATENT DOCUMENTS

| | | | |
|---|---|---|---|
| 2087947 | 6/1982 | United Kingdom | 52/292 |

OTHER PUBLICATIONS

Booklet entitled "Poly-Forms, 108 Sachem St., Norwich, Conn.", undated, 14 sheets.

*Primary Examiner*—Carl D. Friedman
*Assistant Examiner*—Beth A. Aubrey
*Attorney, Agent, or Firm*—Albert W. Hilburger

[57] ABSTRACT

A footing block system is provided for the foundation of a structure and includes a pair of elongated longitudinally extending opposed shells which define a cavity between them for the reception of concrete in slurry form. Each of the shells includes an upright portion having a base adapted to engage the subsurface and an integral transverse portion extending to a rim, the rims of the first and second shells being spaced apart and facing one another. Bridge members are engageable with the opposed shells for joining them a fixed distance apart, mutually interlocking members being provided on the shells and on the bridge members for slidable reception in a longitudinal direction while preventing substantial movement therebetween in a transverse direction. Wall forms are engageable with and supported on the transverse portions of the shells and define a second cavity for the reception of concrete in slurry form, the first and second cavities being in mutual communication. When the concrete hardens, a unified footing and wall structure results.

32 Claims, 5 Drawing Sheets

SYSTEM FOR BUILDING A STRUCTURE

BACKGROUND OF THE INVENTION

1. Field of the Invention

The present invention relates generally to building construction and, more particularly, to a novel system for constructing the foundation and walls of a structure.

2. Description of the Prior Art

It has long been known to construct foundations and structures utilizing interlocking components. For example, in U.S. Pat. No. 1,340,656 issued May 18, 1920 to Hughes et al., an all-concrete mausoleum structure is disclosed which is provided with side walls, rear and front walls, respectively, built on a foundation formed with a longitudinally disposed groove. The lower construction is surmounted by a cap or roof member comprising a single slab or a plurality of slabs interlocked by means of tenons and cooperating slots. The roof member forms a locking device that ties the whole structure together.

More recently, in U.S. Pat. No. 2,134,941 issued Nov. 1, 1938 to Guignon, Jr., building units are disclosed which are in the nature of a block formed of sheet metal and comprising two complementary halves that may be fitted together on the job and filled with insulating material.

In U.S. Pat. No. 2,676,482 issued Apr. 27, 1954 to Wilson, a wall of reinforced spaced building blocks are disclosed which are constructed of cement, stone, tile, and the like. A ladder-shaped frame is utilized for interconnecting the building blocks.

For many years, footings and walls constructed of concrete have customarily required a combination of metal and wooden forms which are erected in place after a proper excavation has been made. Thereafter, concrete is poured into the cavity defined by the form and allowed to harden. When the concrete is sufficiently hard, typically after a day or two, the forms are removed. Some parts of the forms can be re-used and other parts must be discarded. Also, the described activity is labor intensive. In short, current practice results in a substantial amount of waste, both time-wise and material-wise.

Still more recently, with the advent of light weight plastic foam materials, a number of constructions have been suggested for use as external wall forms for receiving concrete having a slurry composition. The following U.S. patents all disclose block forms of such light weight plastic foam material, each with a tongue and groove construction for erecting concrete walls: U.S. Pat. No. 4,894,969 issued Jan. 23, 1990 to Horobin, U.S. Pat. No. 4,967,528 issued Nov. 06, 1990 to Doran, and U.S. Pat. No. 5,086,600 issued Feb. 11, 1992 to Holland et al. At the same time, there has been no recent improvement, known to the inventor, to the manner of constructing the footing on which the wall forms and resulting walls are supported.

It was in light of the foregoing state of the prior art that the present invention was conceived and now has been reduced to practice.

SUMMARY OF THE INVENTION

The present invention relates to a footing block system which is provided for the foundation of a structure. The system comprises a pair of elongated longitudinally extending opposed shells which define a cavity between them for the reception of concrete in slurry form. Each of the shells includes an upright portion having a base adapted to engage the subsurface and an integral transverse portion extending to a rim, the rims of the first and second shells being spaced apart and facing one another. Bridge members are engageable with the opposed shells for joining them a fixed distance apart, mutually interlocking members being provided on the shells and on the bridge members for slidable reception in a longitudinal direction while preventing substantial movement therebetween in a transverse direction. Wall forms are engageable with and supported on the transverse portions of the shells and define a second cavity for the reception of concrete in slurry form, the first and second cavities being in mutual communication. When the concrete hardens, a unified footing and wall structure results.

Accordingly, it is a primary object of the invention to provide a novel system for constructing the foundation of a structure.

Another object of the invention is to provide such a system which can be easily used and employs readily available, and easily formable, materials and which results in minimal waste of materials. The primary material preferably employed for purposes of the invention is an expanded plastic such as polystyrene.

A further object of the invention is to provide such a system which is economical from a standpoint of fabrication as well as from a standpoint of use.

Still another object of the invention is to provide such a system which can be safely used and is environmentally inert.

Yet another object of the invention is to provide such a system which utilizes components which are relatively compact, light in weight, portable, and which can be pre-assembled away from the job site, then finally assembled at the job site with minimal additional effort.

Still a further object of the invention is to provide such a system which can enable persons having minimal experience to successfully fabricate structural foundations and without requiring the use of special tools.

Yet another object of the invention is to provide for the construction of a foundation in a manner which assures integrity between footing and walls and thereby prevents penetration of radon into the resulting structure.

Yet a further object of the invention is the provision of a system enabling the continuous pour of concrete for footing, walls, and concrete slab.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate some of the embodiments of the invention and, together with the description, serve to explain the principles of the invention in general terms. Like numbers refer to like parts throughout the disclosure.

DETAILED DESCRIPTION OF THE PREFERRED EMBODIMENTS

Figure 1:
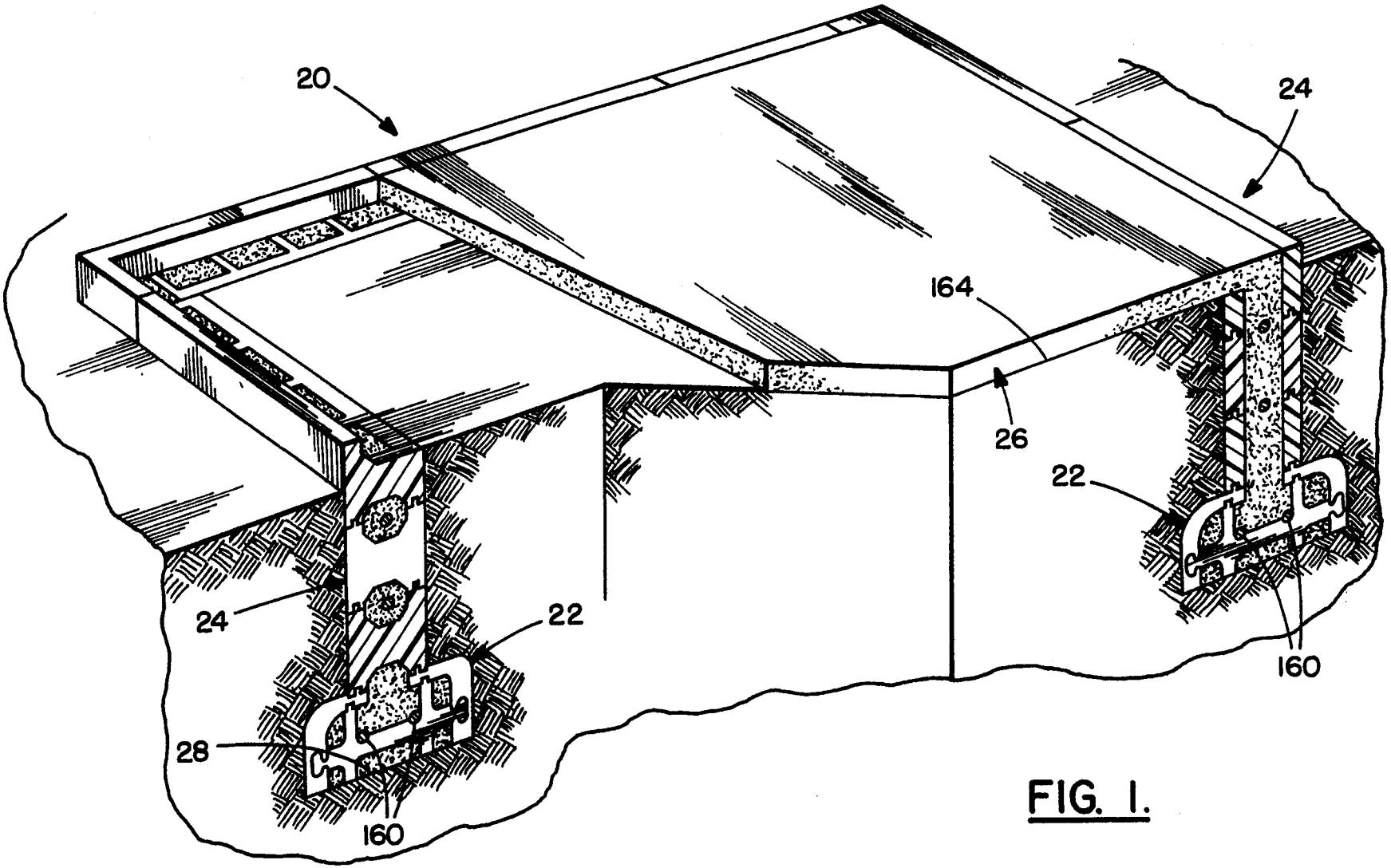
FIG. 1 is a perspective view, partly cut away and in section, illustrating the combination of a footing block system, a wall form system, and a concrete slab to which a continuous pour of concrete is being made, all according to the invention.

Turn now to the drawings and, initially, to FIG. 1 which generally illustrates an overall system 20 for fabricating the foundation of a structure, the system 20 comprising a footing block system 22, a wall form system 24, and a concrete slab 26. For purposes of this disclosure, concrete is considered to be a building material comprised of a mixture of cement, aggregate of sand and stones, and water which hardens to a strong state when the water evaporates. It is customary for the concrete to be poured in a "liquid" or slurry state which is a watery mixture of moderate viscosity. After a period of hours, the concrete hardens to an extent that it can bear substantial loads, but only after a much longer period of time does it cure to its maximum strength. For purposes of the present invention, other suitable materials which have a slurry consistency for introduction into a mold cavity and which harden to a structure-bearing capability are intended to be included by that term even though they may not be strictly within the usual definition of concrete.

As is customary for the construction of any foundation, it is necessary to make an excavation at the building site having an appropriate depth and outer dimensions to accommodate a building to be constructed. A substantially level subsurface 28 is then prepared, at least in the manner of a trench defining the outer periphery of the intended foundation of the structure. The footing block system is then placed onto the subsurface 28 in a manner to be described.

Figure 2:
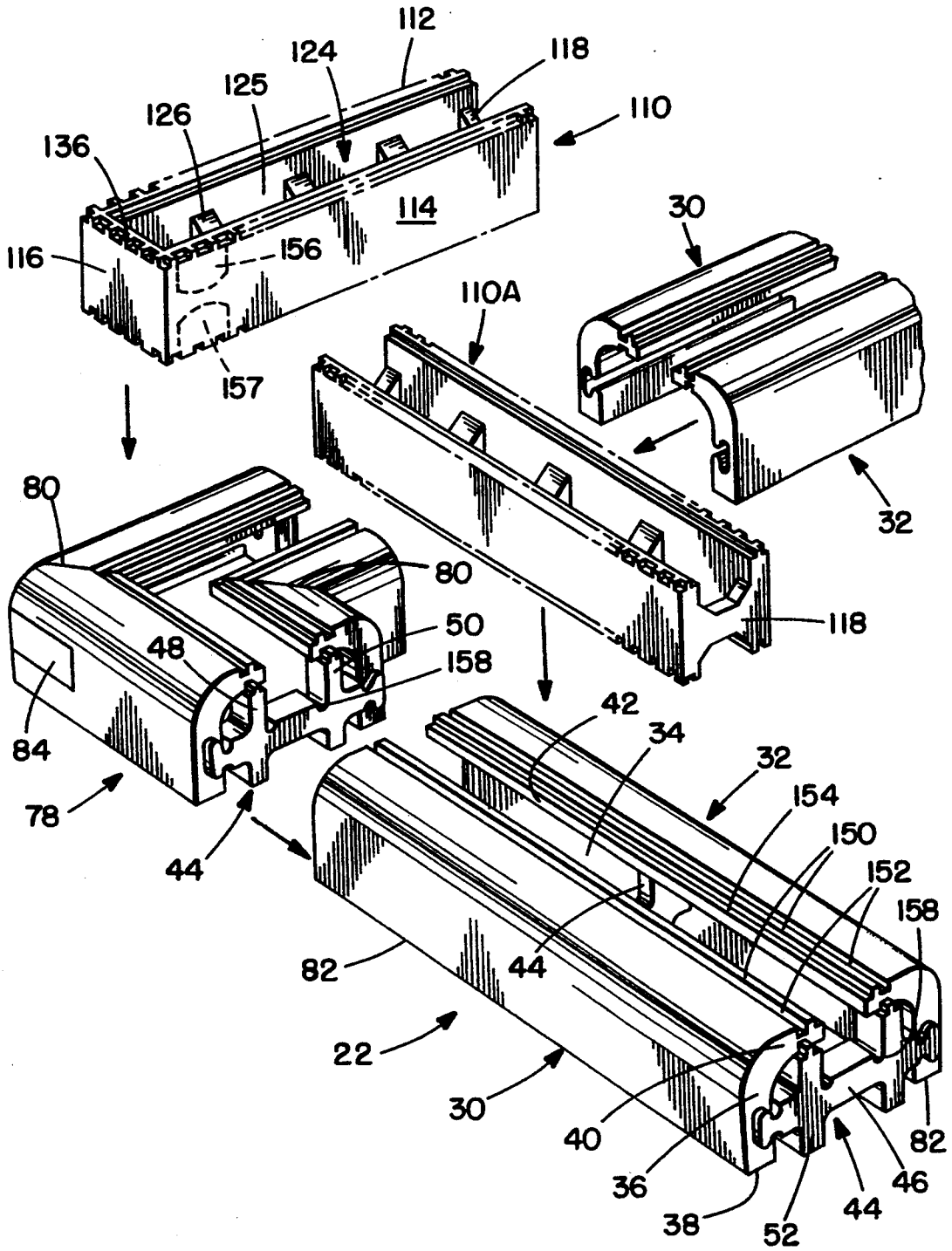
FIGS. 2 and 3 are perspective exploded views, respectively, depicting the construction of the overall system of the invention combining a footing block system and a wall form system.
Figure 3:
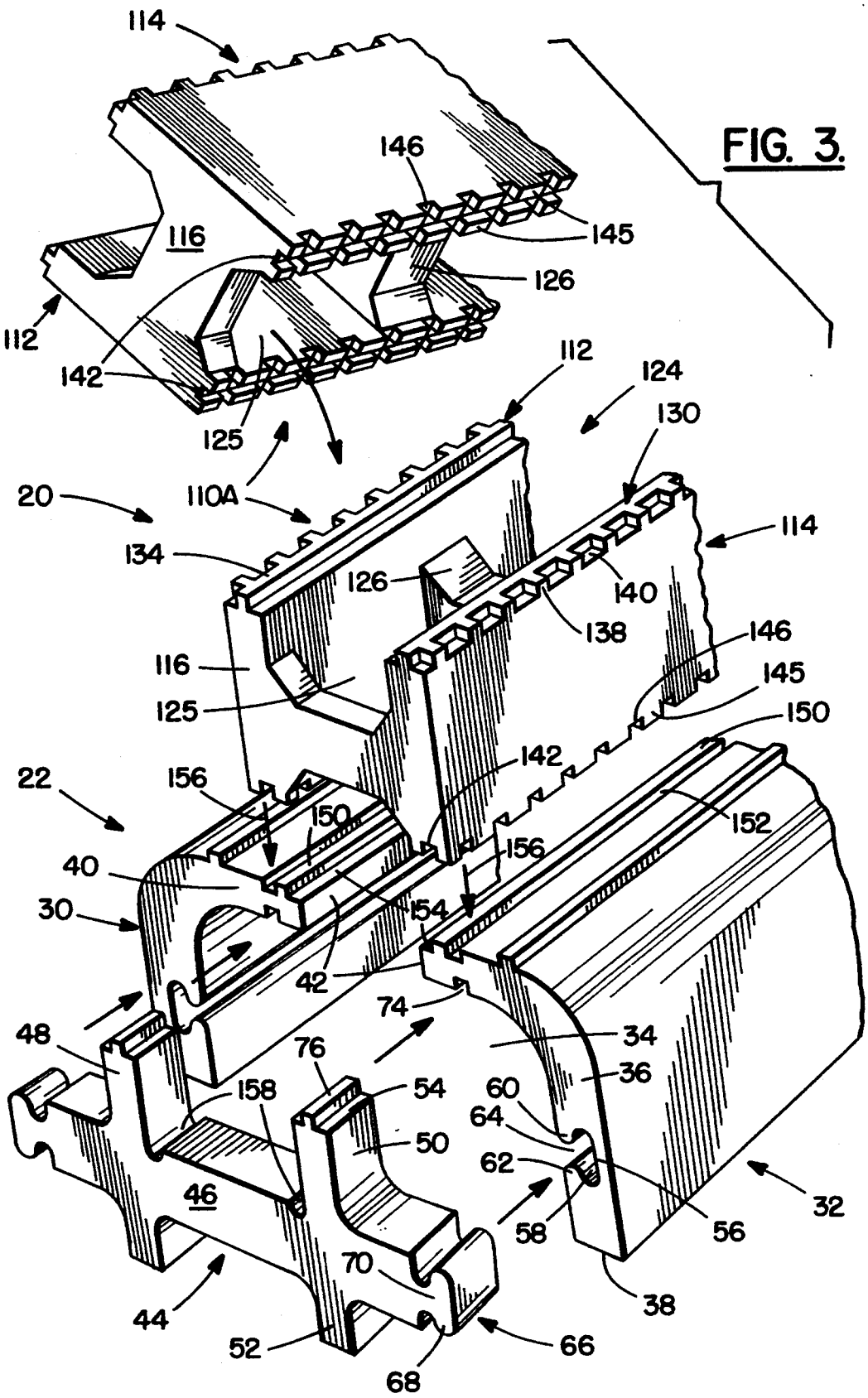

The footing block system 22 is more clearly illustrated in FIGS. 2 and 3. It comprises a pair of opposed congruent but mirror-imaged elongated longitudinally extending opposed shells 30, 32, respectively, so positioned and spaced as to define an intermediate cavity 34. The shells 30, 32 are preferably comprised of a lightweight plastic material, a particular example of which is expanded polystyrene. Such material has the capability of being 100% recyclable and itself can be made by utilizing up to approximately 25% recycled materials. Each shell includes an upright portion 36 having a base 38 adapted to engage the subsurface 28 and an integral transverse portion 40 extending to a rim 42.

Figure 4:
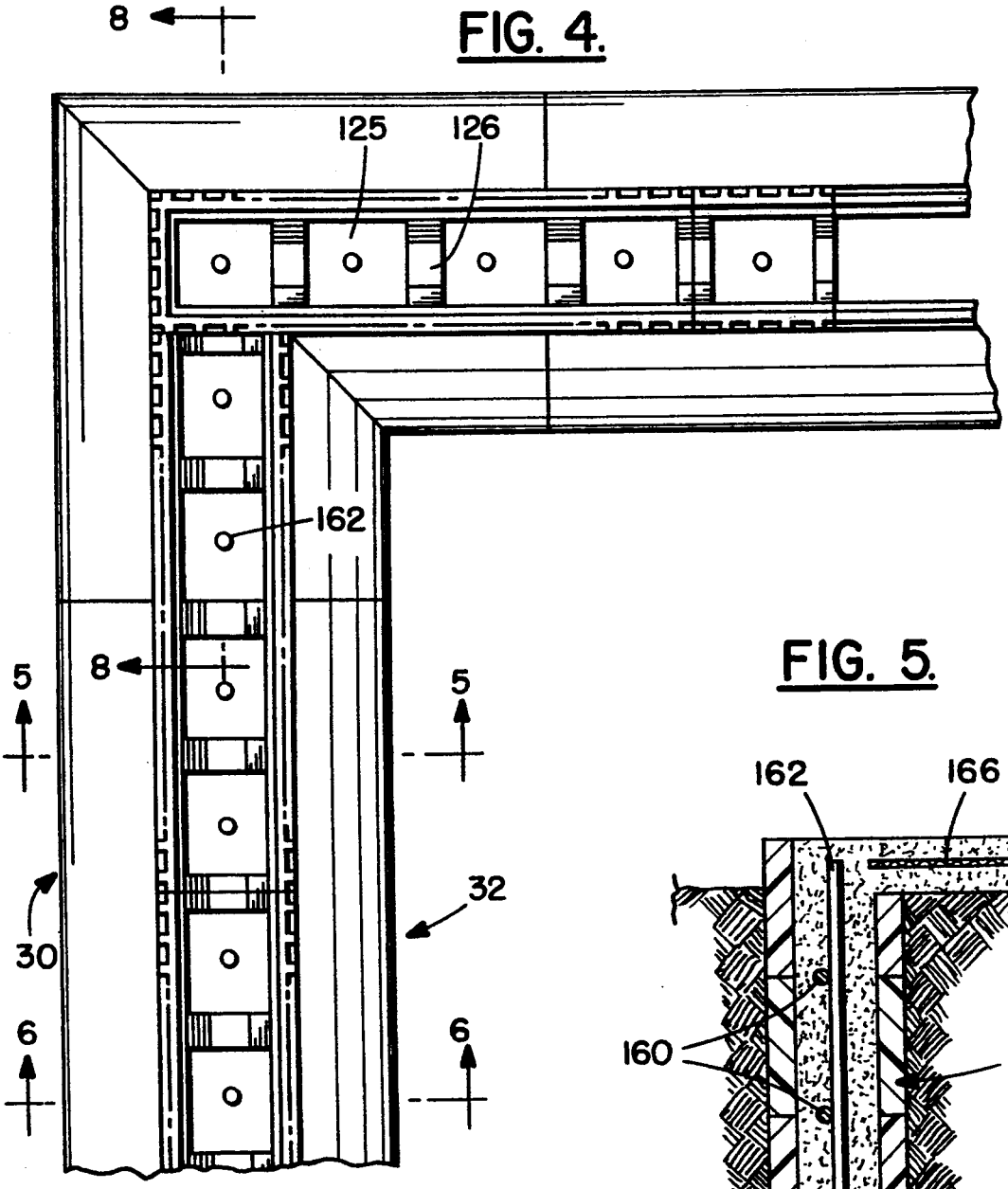
FIG. 4 is a top plan view of a portion of the combination illustrated in FIG. 1.

The rims 42 of the shells 30, 32 are spaced apart and face one another. This construction of an assembled system can most clearly be seen with reference to FIGS. 4, 5, and 6.

A plurality of bridge members 44, preferably comprised of the same material as the shells 30, 32, are utilized by the system 22. They are engageable with the shells 30, 32 and serve to join them while holding them a fixed distance apart. Each bridge member includes a main body 46 and an integral pair of spaced apart upright support members 48, 50 which extend transversely of the main body 46 between a foot 52 engageable with the subsurface 28 and a shoulder 54 (FIG. 3) underlying an associated transverse portion 40 of one of the shells 30, 32.

The upright portion 36 of each of the shells 30, 32 has a longitudinally extending groove 56 (see FIG. 3) which is generally parallel with and spaced from the base 38. The groove 56 includes an enlarged channel 58 and opposed peninsulas 60, 62 adjacent the enlarged channel defining a reduced slot 64 therebetween.

In turn, each of the bridge members 44 includes opposed tongues 66 which project from opposite ends of the main body 46 and are intended for interlocking slidable engagement with the longitudinally extending grooves 56 in an associated shell 30, 32. The tongues 66 are shaped for interlocking slidable engagement with the grooves 56 and serve the purpose of joining the opposed shells 30, 32 while substantially preventing transverse relative movement between shells. To this end, each of the tongues 66 includes an enlarged head 68 and a reduced neck 70 connecting the head to the main body 46. The dimensions of the head 68 are slightly smaller than those of the enlarged channel 58 and the dimensions of the reduced neck 70 are slightly smaller than the spacing between, and other dimensions, of the peninsulas 60, 62 on the associated shells 30, 32.

With continued reference to FIGS. 2, 3, 5, and 6, it is seen that each transverse portion 40 of the shells 30, 32 has an underlying surface 72 (FIGS. 5 and 6) facing the cavity 34 and is formed with a longitudinally extending slot 74 therein. In cooperating fashion, each of the upright support members 48, 50 has an elongated rib 76 which is slidably engageable with an associated slot 74. The shoulders 54 on the upright support members 48, 50 are of such a height that with the ribs 76 engaged with their associated slots 74, downward forces applied on the transverse portions 40 will result in substantially no deflection thereof relative to the upright portions 36.

Thus, when a bridge member 44 is slidably engaged with the shells 30, 32 such that the tongues 66 are engaged with their associated grooves 56 and the ribs 76 are engaged with their associated slots 74, the shells 30, 32 are held in a substantially rigid fashion a spaced distance apart and substantial vertical forces applied to the transverse portions 40 can be resisted. According to the invention, a plurality of the bridge members 44 are located at spaced distances along the length of the shells 30, 32. Furthermore, the bridge members 44 are also positioned to serve as connections between adjoining shells 30, 32 when they are placed in end to end relationship. Specifically, as most clearly illustrated in FIG. 2, a bridge member 44 is partially engaged with one pair of shells 30, 32 and projects a sufficient distance beyond the ends of those shells to similarly engage an adjoining pair of shells. In this manner, bridge members 44 not only maintain separation and structural integrity to the shells 30, 32, but also serve as connectors between adjoining shell pairs.

Figure 7:
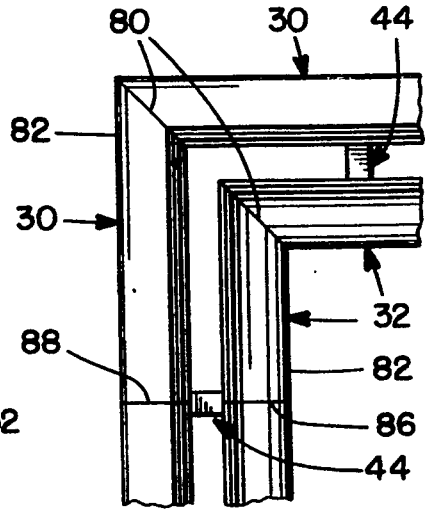
FIG. 7 is a detail top plan view of a portion of the construction illustrated in FIG. 1.

Turn now to FIG. 2 for a description of a corner unit 78 utilized with the footing block system 22. A significant benefit of the invention resides in the construction whereby the fewest possible components are required and used. Indeed, according to the footing block system 22 of the invention, only two separate components are necessary, namely shells 30, 32 and bridge members 44. As previously explained, the shells 30, 32 are identical, a shell 30 merely being a mirror image, or reverse, of a shell 32. For purposes of a corner unit 78, the shells 30, 32 may be suitably cut, as by sawing, on a bias line 80 which is at a forty-five degree angle relative to a longitudinal edge 82, or surface, of the shells. The mating surfaces of the adjoining shells 30 are then joined. This may be accomplished by the use of duct tape 84 (FIG. 2), for example, or, preferably, by means of a suitable adhesive of the type which will not attack the composition of the shells. The inner track shells 32 will have to be shortened, as by sawing, so that a transverse joint line 86 (FIG. 7) of an "inner" shell 32 is lined with a transverse joint line 88 of an "outer" shell 30. In this manner, a subsequent set or pair, of shells 30, 32 can be placed in position, then joined as by duct tape or by adhesive to its adjoining corner set.

While the dimensions of the footing block system 22 are arbitrary, a typical set of such dimensions would have the uppermost surface of the shells 30, 32 be twelve inches above the subsurface 28, a total width defined by opposing shells 30, 32 of twenty-four inches, and the length of each shell being forty-eight inches.

It will be appreciated that the footing block system 24 may be cut, then assembled, on site, or such cutting and assembly may be performed off site, as dictated by individual job circumstances. The footing block system is easily transportable to the job site due to light weight and its relatively compact size.

The wall form system 24 intended for use in combination with the footing block system 22 will now be described. As seen especially in FIGS. 1, 2, 5, and 6, the wall form system 24 is generally depicted as a monolithic concrete-block form 110 having a substantially elongated body structure defined by oppositely disposed side walls 112 and 114, end wall designated generally at 116, and bridge 118. The block form 110 is used exclusively in corner constructions. A slightly different block form 110A is used at all other locations in conjunction with the block form 110. The block form 110A differs only in having bridges 118 at both ends.

Side walls 112 and 114, end wall 116, and bridge 118 together define a box-like structure which is made from an expandable polystyrene or like synthetic material having an elongated body cavity, indicated generally at 124. The body cavity is further defined by a plurality of cell sections 125 (FIG. 4) which are provided between successive pairs of a plurality of transverse strut members 126. The strut members 126 together with end wall 116 and bridge 118, serve to separate and provide the necessary support for the side walls 112, 114.

Interlocking means are also provided, whereby the concrete-block forms are readily stackable, one on top of the other in an interlocking relationship, without the need for mortar or any other binder prior to pouring concrete within the body cavities. Generally, viewing FIG. 3, interlocking means indicated at 130 comprise an elongated rail 134 formed along the upper longitudinal edge of each side wall and end wall alike. That is, each end wall 116 includes an interlocking cross rail member 136. The oppositely disposed rail members 134 and 136 are further formed with lateral locking arm members 138 which effectively define sockets 140.

In order to form a positive interlocking arrangement, the lower longitudinal edges of each block form 110, 110A are formed with corresponding longitudinal channels 142 (better seen in FIG. 3). Channel 142 extends the full length of each side wall 112 and 114. Channel 142 is provided with a plurality of laterally extending, equally-spaced channels 146 that define post members 145. Accordingly, when forms 110, 110A are stacked, rails 134 are positioned in channels 142, and locking arm members 138 are engaged with lateral channels 146. It should be noted that the interengaging surfaces or walls of the rails 134, locking arm members 138, sockets 140, and channels 142 are preferably formed with an inward taper from top to bottom thereof for ease of their initial engagement and for their retention in the engaged condition.

Consider now the overall system 20, viewing especially FIGS. 2 and 3, in which the block forms 110, 110A are suitably mounted on the shells 30, 32. Extending along an upper surface of the transverse portions 40 of each of the shells 30, 32 is an elongated longitudinally extending connection ridge 150 positioned parallel to the rim 42 and defined by a pair of longitudinally extending connection slots 152, 154. With the shells 30, 32 supported on the subsurface 28 in juxtaposed position, as illustrated in FIGS. 2 and 3, and joined by the bridge members 44 in the manner earlier described, a row of the block forms 110 is then appropriately mounted onto associated shells 30, 32. To this end, a block form 110 is lowered into position in the direction of arrows 156 (FIGS. 2 and 3) until the post members 145 are slideably received within the connection slots 152, 154.

Simultaneously, a connection ridge 150 from each shell is slideably received in an associated channel 142 of an associated block form 110. The block forms 110 are placed in end to end relationship continuing along the entire course defined by the shells 30, 32 of the footing block system 22.

At a corner location, viewing FIG. 2, one of the block forms 110 has an end wall 116 which is fully closed. When block form 110A is positioned in engaging relationship with the block form 110 adjacent end wall 116, suitable cutouts 156, 157 in the side wall 114 of the block form 110 must be made. These cutouts are indicated by dashed lines in FIG. 2 and enable the ease of flow of concrete in the slurry form in a manner to be described. It will usually be necessary to cut a last block form 110, 110A to proper length to complete a course for one wall of the foundation. Being comprised of an expanded plastic material, this is not a difficult task although it should be carefully performed. As with the shells 30, 32, it is desirable to use a suitable adhesive to bond together adjoining block forms after they are all in position on the footing block system 22.

Figure 5:
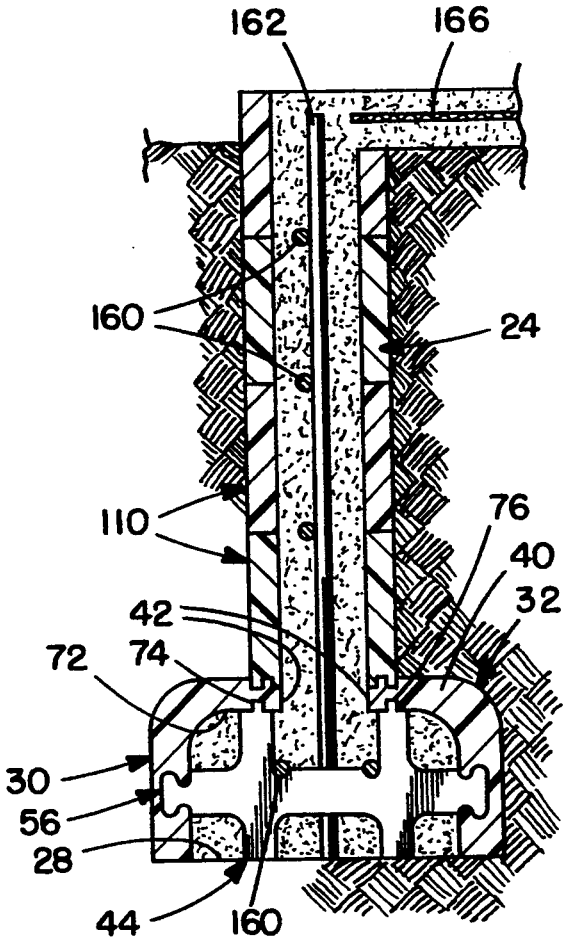
FIG. 5 is a cross section view taken generally along line 5—5 in FIG. 4.
Figure 8:
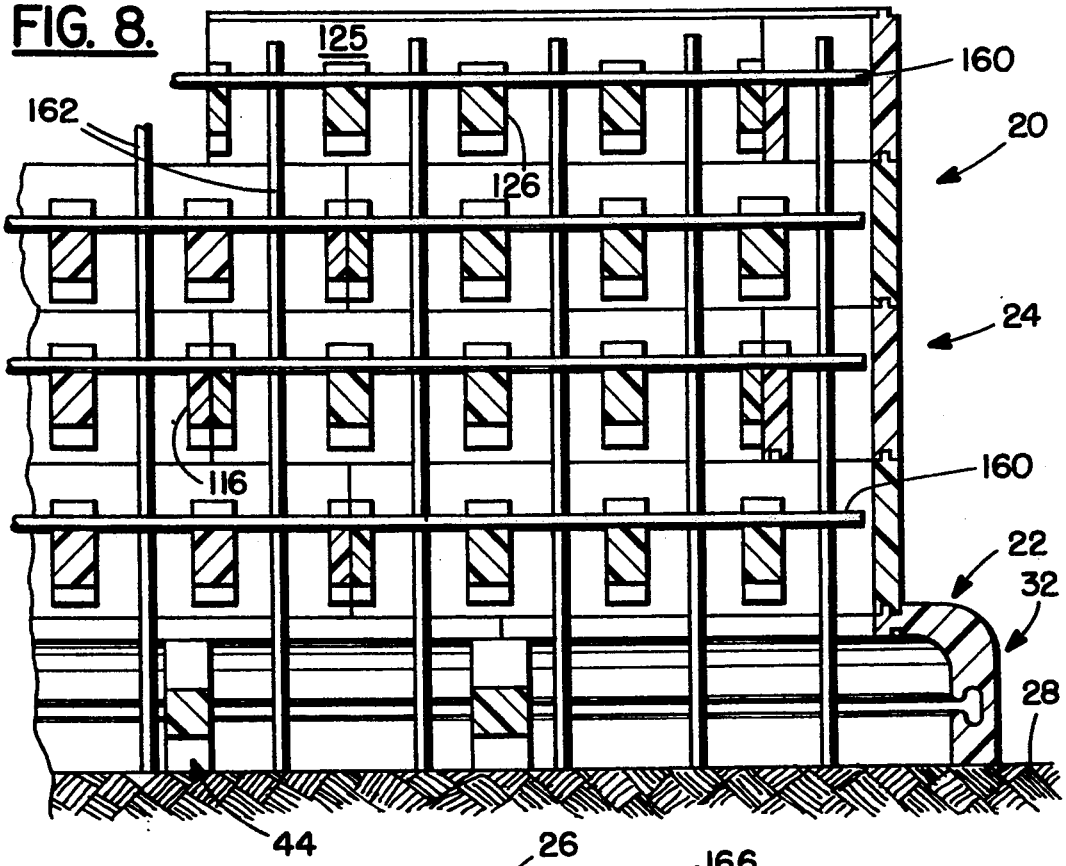
FIG. 8 is a detail cross section view, in elevation, taken generally along line 8—8 in FIG. 4.
Figure 6:
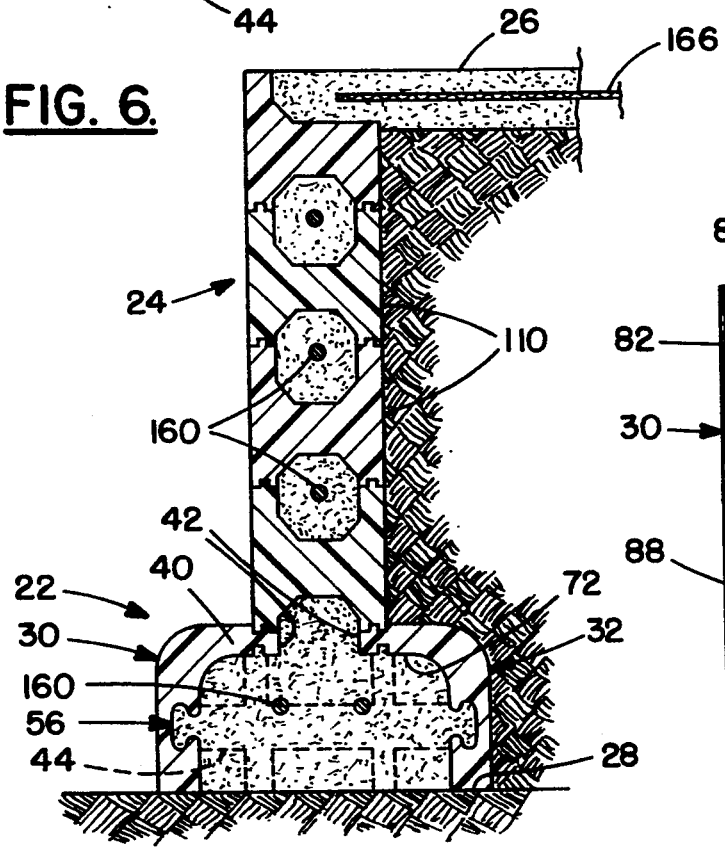
FIG. 6 is a cross section view taken generally along line 6—6 in FIG. 4.

After a first level of the block forms 110, 110A has been positioned on the footing block system 22, additional levels of the block forms are to be added in the manner indicated in FIGS. 1, 5, and 6, preferably staggered in the manner of bricks so that a joint between one pair of block forms on one level will not be coincident with a joint between an adjoining pair of block forms on the next succeeding level. The number of levels of block forms 110, 110A to complete a wall form system 24 is arbitrarily chosen according to the depth of the excavation and the height of the wall desired above ground level. When an uppermost course of the block forms 110 has been completed, the excavation may be backfilled carefully to assure no harm to the footing block system 22 and to the wall form system 24. Concrete in its slurry form is then poured into the overall system 20. Alternatively, the pour of concrete may be performed first and only after it achieves a sufficiently hardened condition would backfill be accomplished.

It will be appreciated that in all instances, reinforcement for the resulting concrete structure must be provided. In this regard, with respect to the footing block system 22, longitudinally extending troughs 158 are formed on an upper surface of the main body 46 of each bridge member 44 immediately adjacent the upright support members 48, 50. Elongated reinforcing bars 160 are placed on the longitudinal troughs 158 of successive bridge members 44 for the entire length of the footing block system 22. Additionally, reinforcing bars 160 are positioned horizontally on the upper surfaces of the strut members 126 and bridge members 118 for each level of the block forms 110, 110A. Concrete in its slurry form is then poured into and through the top row of block forms 110, 110A until the cavity 34 for each set of shells 30, 32 is completely filled. Thereafter, the pour of concrete continues until all the layers of block forms 110, 110A are filled with concrete.

At some suitable time during the pour of the concrete, reinforcing bars 162 must be added to the system 20. The reinforcing bars 162 may be similar to the reinforcing bars 160. Their placement may be at any desired time during the pour of the concrete. It may be, for example, that they would be inserted through the uppermost course of the block forms 110, 110A when there had been a sufficient pour of concrete to assure that they would retain a substantially upright position when left unattended following their insertion. Thus, it may be desirable to place the reinforcing bars 162 generally within each cell section 125 of the wall form system 24. This construction is particularly well seen in FIGS. 4, 5, 6, and 8.

In certain instances, it may be desirable to form a concrete slab 26 close to ground level, as seen in FIG. 1. To this end, in keeping with the invention, it is possible to form the footing block system 22, the wall form system 24, and the concrete slab 26 all during the same pour of concrete. In this instance, the interior region of the excavation, that is, the excavation defined as lying within the confines of the footing block system 22 and the wall form system 24 will have been backfilled prior to the pour of the concrete slurry, and graded, to provide a subsurface 164 for the concrete slab. As seen in FIG. 6, suitable wire mesh is placed just above the subsurface 164 prior to pouring the concrete slurry and may extend into the body cavity 124 of each block form 110, 110A. The pour of concrete then proceeds. When the level of the pour will have reached, then exceeds, the level of the subsurface 164, it continues until the slab 26 will have been created to the desired depth.

In this manner, the major components of a footing block system 22, the wall form system 24, and the concrete slab 26 can all be formed at a single time resulting in maximum integrity of the final structure.

The footing block system 22 and the wall form system 24 remain in place on a permanent basis. These provide for a built-in insulation factor of R-18, or better. The expanded plastic material of the systems 22, 24 also cause a longer curing time for the concrete, thereby creating a stronger structure. Of course, it will also be appreciated that the form blocks 110, 110A can be so formed as to provide for windows and doors in predetermined locations prior to pouring the concrete. Such an expedient provides still a further savings of time and effort in the construction of a foundation.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A footing block system for the foundation of a structure comprising:

first and second elongated longitudinally extending opposed shells defining a cavity therebetween for the reception of concrete in slurry form, each of said shells including an upright portion having a base adapted to engage the subsurface and an integral transverse portion extending to a rim, said rims of said first and second shells being spaced apart and facing one another;

bridge means engageable with said first and second shells for joining said first and second shells a fixed distance apart; and mutually interlocking means on said first and second shells and on said bridge means for slidable reception of said bridge means with said first and second shells in a longitudinal direction while preventing substantial movement therebetween in a transverse direction;

wherein said upright portion of said first shell has a longitudinally extending groove therein generally parallel with and spaced from said base thereof;

wherein said upright portion of said second shell has a longitudinally extending groove therein generally parallel with and spaced from said base thereof; and wherein said bridge means includes first and second tongues shaped for interlocking slidable engagement with the longitudinally extending grooves in said upright portions of said first and second shells, respectively, while substantially preventing relative transverse movement between said bridge means and said first and second shells.

2. A footing block system as set forth in claim 1 wherein said bridge means includes a main body;

wherein each of said first and second tongues includes an enlarged head and a reduced neck connecting said head to said main body; and wherein the longitudinally extending groove in said upright portion of each of said first and second shells includes an enlarged channel for slidably receiving said associated enlarged head; and wherein each of said upright portions includes opposed peninsulas defining a reduced slot adjacent the associated enlarged channel for slidable engagement with said associated reduced neck.

3. A footing block system as set forth in claim 1 wherein said bridge means includes: a first upright support member integral with said main body extending transversely thereof between a foot engageable with the subsurface and a shoulder underlying said transverse portion of said first shell;

a second upright support member integral with said main body extending transversely thereof between a foot engageable with the subsurface and a shoulder underlying said transverse portion of said second shell;

each of said transverse portions of said first and second shells having an underlying surface facing the cavity with a longitudinally extending slot therein;

said first and second upright support members having an elongated rib slidably engageable with an associated one of the longitudinally extending slots in said transverse portions.

4. A footing block system as set forth in claim 3 including a plurality of said bridge means engaged with said first and second shells at spaced apart longitudinal locations.

5. A footing block system as set forth in claim 1 including a wall form having a plurality of interlocking teeth thereon;

wherein each of said transverse portions of said first and second shells has an overlying surface facing away from the cavity with a longitudinally extending slot therein for engageable reception with said interlocking teeth of said wall form.

6. A footing block system as set forth in claim 1 wherein said first and second shells are congruently shaped.

7. A footing block system as set forth in claim 1 wherein said bridge means includes a main body having an upper surface and having at least one longitudinally extending trough formed therein for reception thereon of an elongated reinforcing bar.

8. A footing block system as set forth in claim 1 including concrete filling the cavity, said concrete originally introduced in the slurry form and subsequently cured to its hardened condition.

9. A footing block system as set forth in claim 1 wherein each of said bridge means includes a main body having an upper surface and having at least one longitudinally extending trough formed therein; and including:

a plurality of said bridge means mounted to first and second shells at a plurality of longitudinally spaced locations;

an elongated reinforcing bar received on an aligned plurality of said longitudinally extending troughs; and concrete filling the cavity, thereby enveloping said reinforcing bar, said concrete originally introduced in the slurry form and subsequently cured to its hardened condition.

10. A footing block system as set forth in claim 1 wherein said first and second shells and said bridge means are comprised of a lightweight plastic material.

11. A footing block system as set forth in claim 10 wherein said plastic material is expanded polystyrene.

12. A system for building a structure comprising:

first and second elongated longitudinally extending opposed shells defining a first cavity therebetween for the reception of concrete in slurry form, each of said shells including an upright portion having a base adapted to engage the ground and an integral transverse portion extending to a rim, said rims of said first and second shells being spaced apart and facing one another, said upright portions of said first and second shells having a longitudinally extending groove therein generally parallel with and spaced from said base;

bridge means for joining said first and second shells a fixed distance apart including first and second tongues shaped for interlocking slidable engagement with the longitudinally extending grooves in said upright portions of said first and second shells, respectively, while substantially preventing relative transverse movement between said bridge means and said first and second shells;

mutually interlocking means on said first and second shells and on said bridge means for slidable reception of said bridge means with said first and second shells in a first direction while preventing substantial movement therebetween in a second, transverse, direction; and wall form means engageable with and supported on said transverse portions of said first and second shells, said wall form means defining a second cavity for the reception of concrete in slurry form, the first and second cavities being in mutual communication.

13. A system for building a structure as set forth in claim 12 wherein said wall form means includes:

a substantially rectangular, box-like, block form having a pair of oppositely disposed, parallel, spaced apart side walls and oppositely disposed end walls extending between upper and lower edges and defining the second cavity therein;

a plurality of strut members extending transversely of said side walls at spaced longitudinal locations and integrally joined to said side walls;

interlocking means formed about the peripheral edges of said side walls and said end walls, said interlocking means including an elongated rail member extending along said upper edge of said side walls and said end walls, said rail member including laterally outward extended finger members equally spaced apart from each other along the length thereof;

an elongated channel member formed longitudinally along said lower edge of each of said side walls and end walls, said channel member including laterally outward extended channel members, and said rail and arm members being positioned to be interlocked within respective channels of said lower edges of said walls when said blocks are stacked in a vertical relationship to form a building structure;

said rail and said lateral arm members defining a plurality of contiguous sockets adjacent the outer edges of said wall members, and said lateral channel members defining a plurality of contiguous post members that are arranged to be lockingly engaged in corresponding sockets when said block forms are stacked one above the other.

14. A system for building a structure as set forth in claim 13 wherein each of said transverse portions of said first and second shells has an overlying surface facing away from the first cavity and including a longitudinally extending rail thereon for engageable reception with said channel member of said side wall.

15. A system for building a structure as set forth in claim 14 wherein said bridge means includes:

a main body;

a first upright support member integral with said main body extending transversely thereof between a foot engageable with the subsurface and a shoulder underlying said transverse portion of said first shell;

a second upright support member integral with said main body extending transversely thereof between a foot engageable with the subsurface and a shoulder underlying said transverse portion of said second shell;

each of said transverse portions of said first and second shells having an underlying surface facing the cavity with a longitudinally extending slot therein;

said first and second upright support members having an elongated rib slidably engageable with an associated one of the longitudinally extending slots in said transverse portions.

16. A system for building a structure as set forth in claim 15 including:

concrete filling the second cavity and an excavated cavity adjacent said wall form means, said concrete initially introduced into the second cavity and the excavated cavity in the slurry form;

a layer of wire mesh extending between a first location positioned within the second cavity and a second end positioned within the excavated cavity, said concrete enveloping said wire mesh within both the second cavity and the excavated cavity, said concrete originally introduced into the second cavity and into the excavated cavity in the slurry form and subsequently cured to its hardened condition.

17. A system for building a structure as set forth in claim 12 wherein each of said first and second tongues includes an enlarged head and a reduced neck connecting said head to said main body; and wherein the longitudinally extending groove in said upright portion of each of said first and second shells includes an enlarged channel for slidably receiving said associated enlarged head; and wherein each of said upright portions includes opposed peninsulas defining a reduced slot adjacent the associated enlarged channel for slidable engagement with said associated reduced neck.

18. A system for building a structure as set forth in claim 12 including a plurality of said bridge means engaged with said first and second shells at spaced apart longitudinal locations.

19. A system for building a structure as set forth in claim 17 wherein each of said bridge means includes a main body having an upper surface and having at least one longitudinally extending trough formed therein; and including:

a plurality of said bridge means mounted to first and second shells at a plurality of longitudinally spaced locations;

an elongated reinforcing bar received on an aligned plurality of said longitudinally extending troughs; and concrete filling the first cavity, thereby enveloping said reinforcing bar, said concrete originally introduced in the slurry form and subsequently cured to its hardened condition.

20. A system for building a structure as set forth in claim 19 including:

concrete filling the second cavity, initially introduced in the slurry form;

a reinforcing bar placed substantially in the horizontal orientation on said plurality of strut members and extending longitudinally of the second cavity;

said concrete enveloping said reinforcing bar and subsequently cured to its hardened condition.

21. A system for building a structure as set forth in claim 12 wherein said first and second shells are congruently shaped.

22. A system for building a structure as set forth in claim 12 wherein said bridge means includes a main body having an upper surface and having at least one longitudinally extending trough formed therein for reception therein of an elongated reinforcing bar.

23. A system for building a structure as set forth in claim 12 including concrete filling the first and second cavities, said concrete originally introduced in the slurry form and subsequently cured to its hardened condition.

24. A system for building a structure as set forth in claim 12 wherein said first and second shells, said bridge means, and said wall form means are comprised of a lightweight plastic material.

25. A system for building a structure as set forth in claim 24 wherein said plastic material is expanded polystyrene.

26. A method of constructing a structure comprising the steps of:

(a) excavating a trench generally defining the plan outline of the structure to be constructed;

(b) substantially levelling the subsurface of the trench;

(c) positioning in the trench first and second elongated longitudinally extending opposed shells defining a first cavity therebetween for the reception of concrete in slurry form, each of the shells including an upright portion having a base adapted to engage the subsurface and an integral transverse portion extending to a rim, the rims of the first and second shells being spaced apart and facing one another; and (d) joining to the first and second opposed shells a plurality of bridge members engageable with the upright portions thereof at a plurality of spaced apart locations for maintaining the first and second shells a fixed distance apart;

(e) pouring concrete in slurry form into the first cavity; and (f) allowing the concrete to cure to thereby provide a hardened footing for the foundation of the structure.

27. A method of constructing a structure as set forth in claim 26 wherein step (c) includes the step of:

(g) mutually interlocking the first and second shells with the bridge members to enable slidable reception of the bridge members with the first and second shells in a longitudinal direction while preventing substantial movement therebetween in a transverse direction.

28. A method of constructing a structure as set forth in claim 26 including the steps of:

(g) positioning wall form members in engagement with and supported on the transverse portions of the first and second shells, the wall form members defining a second cavity for the reception of concrete in slurry form, the first and second cavities being in mutual communication.

29. A method of constructing a structure as set forth in claim 26 including the steps of:

(g) forming a longitudinally extending trough on the upper surface of each of the bridge members;

(h) positioning an elongated reinforcing bar on an aligned plurality of the longitudinally extending troughs; and (i) pouring concrete in the slurry form into the first cavity;

(j) filling the first cavity with concrete thereby enveloping the reinforcing bar;

(k) curing the concrete to its hardened condition.

30. A method of constructing a structure as set forth in claim 29 including the steps of:

(l) positioning wall form members in engagement with and supported on the transverse portions of the first and second shells, the wall form members defining a second cavity for the reception of concrete in slurry form and having a plurality of integral transverse strut members within and extending across the second cavity, the first and second cavities being in mutual communication;

(m) pouring concrete in slurry form into the second cavity;

(n) placing a reinforcing bar into the second cavity supported on the plurality of strut members and extending longitudinally of the second cavity such that the concrete envelops the reinforcing bar; and (o) curing the concrete to its hardened condition.

31. A method of constructing a structure as set forth in claim 29 including the steps of:

(l) positioning wall form members in engagement with and supported on the transverse portions of the first and second shells, the wall form members defining a second cavity for the reception of concrete in slurry form, the first and second cavities being in mutual communication;

(m) forming an excavated cavity adjacent the wall form members;

(n) pouring concrete in slurry form into the first, second, and excavated cavities;

(o) placing a layer of wire mesh extending between a first location positioned within the second cavity and a second location positioned within the excavated cavity, such that the concrete envelops the wire mesh within both the second cavity and the excavated cavity;

(p) placing a reinforcing bar into the second cavity horizontally positioned and extending longitudinally of the second cavity such that the concrete supports and envelops the reinforcing bar; and (q) curing the concrete to its hardened condition.

32. A method of constructing a structure as set forth in claim 31 including the step of:

(r) immediately before step (q), inserting into the first and second cavities a plurality of generally vertically oriented elongated reinforcing rods.

* * * * *